United States Patent [19]

Morshauser

[11] 4,234,464

[45] Nov. 18, 1980

[54] DETERGENT BAR COMPOSITION AND BINDER THEREFOR

[75] Inventor: Fred S. Morshauser, Pequannock, N.J.

[73] Assignee: GAF Corporation, New York, N.Y.

[21] Appl. No.: 28,192

[22] Filed: Apr. 9, 1979

[51] Int. Cl.[2] ..... C11D 1/02; C11D 7/32; C11D 17/00

[52] U.S. Cl. ..... 252/544; 252/117; 252/545; 252/550; 252/557; 252/DIG. 2; 252/16

[58] Field of Search ..... 252/117, 544, 545, 550, 252/557, DIG. 16

[56] References Cited

U.S. PATENT DOCUMENTS

| | | | |
|---|---|---|---|
| 2,289,391 | 7/1942 | Tucker | 260/400 |
| 2,385,614 | 9/1945 | Dreger et al. | 252/551 |
| 2,894,912 | 7/1959 | Geitz | 252/121 |
| 2,972,583 | 2/1961 | Hewitt | 252/558 |
| 2,982,737 | 5/1961 | Boettner et al. | 252/545 |
| 3,129,187 | 4/1964 | Meehan | 252/155 |
| 3,291,744 | 12/1966 | Bohrer | 252/554 |
| 3,376,229 | 4/1968 | Haass et al. | 252/117 |
| 3,723,325 | 3/1973 | Parran | 252/106 |
| 3,862,965 | 1/1975 | Werner et al. | 252/555 |
| 3,901,832 | 8/1975 | Dugan et al. | 252/557 |

FOREIGN PATENT DOCUMENTS

| | | |
|---|---|---|
| 1281135 | 11/1961 | France . |
| 799075 | 7/1958 | United Kingdom . |
| 903781 | 8/1962 | United Kingdom . |
| 945062 | 12/1963 | United Kingdom . |

*Primary Examiner*—P. E. Willis, Jr.

*Attorney, Agent, or Firm*—Walter C. Kehm; Joshua J. Ward

[57] ABSTRACT

Detergent bar binder comprising (a) fatty acid or alcohol component having an iodine number less than about 20 and a melting point of at least about 50° C. and being selected from the group consisting of fatty acids or alcohols having from 12 to 22 carbon atoms, mono-, di- or triglycerides of such fatty acids, fatty acid esters of such fatty alcohols and mixtures thereof and (b) alkyl amide represented by the formula:

$$R_1-\overset{\overset{\displaystyle O}{\|}}{C}-NHR_2$$

where $R_1$ represents a straight chain alkyl radical containing from 10 to 22 carbon atoms and $R_2$ represents hydrogen or an alkyl radical containing from 1 to 3 carbon atoms. The binder is used in a non-soap detergent bar containing anionic foaming and foam boosting detergents.

8 Claims, No Drawings

DETERGENT BAR COMPOSITION AND BINDER THEREFOR

BACKGROUND OF THE INVENTION

Synthetic detergent bars, frequently referred to as syndet bars, are well known and are becoming increasingly popular. However, wide spread replacement of soap bars by syndet bars has not so far been possible for a variety of reasons, primarily the poor physical characteristics of syndet bars as compared to soap bars.

Major drawbacks of conventional soap bars for use such as toilet bars include:

(a) The efficacy of soap in regard to detergency and lathering is seriously impaired in hard water due to precipitation of the calcium and magnesium salts of soaps.

(b) In hard water areas precipitated calcium and magnesium salts of soaps adhere to and build up on sinks, bathtubs, etc. giving rise to undesirable "soap ring." The hard water soaps also adhere to the skin and give an uneasy, sticky, dirty feeling.

(c) Soap has an alkaline pH which is somewhat irritating to skin and eyes.

Many synthetic detergents are known which are free from the above deficiencies of soap but despite this, synthetic detergents have not found any appreciable to overwhelmingly dominate this market. The reason for this is that soap has physical properties which make it ideally suited for toilet bars and which cannot be easily duplicated using synthetic detergents.

Synthetic detergents do not possess the physical properties of soap, thus making them unsuitable for forming into a shaped toilet bar as is done with soap. This problem is overcome by blending synthetic detergents with a binder system in an effort to formulate a mass with physical properties more like soap to enable it to be formed into bars. Ingredients generally constituting binder systems are water soluble fatty acids, fatty alcohols, mono-, di-, or triglycerides, fatty acid esters, particularly fatty acid esters with fatty alcohols, lanolin, petrolatum, etc. are suitable preferably melting at 30° to 90° C. Utilization of binder systems of this type results in forming of a synthetic detergent bar with physical properties which are a poor match for soap and having the disadvantages previously disclosed.

Among the physical deficiencies commonly encountered with previously known syndet bars are the following:

(1) Syndet bar masses are generally not efficiently processed into bars with conventional soap bar processing equipment. Bar extrusion is often difficult and much slower in extrusion rate. The cut bars are not easily stamped as they stick to the stamping molds requiring use of refrigerated molds and/or special release agents and techniques. The shape of the bars are often limited to rectangular shapes as the syndet bar is not sufficiently plastic to be formed into highly curved shapes without cracking. Syndet bars tend to have a dry texture with a rough or sandy feel when used. These and other problems occur because the formulated syndet bars do not possess the amorphous, microcrystalline structure of soap and soap's resulting plastic properties and smooth, pleasant texture.

(2) Synthetic detergents useful for syndet bars are more water soluble than soap resulting in rapid wear rate and tending to dissolve more in wet soap dishes than does soap.

Descriptions of typical syndet bars suggested by the Prior Art are included for instance in U.S. Pat. Nos. 2,781,321, 2,894,912 and 3,862,965.

It is desirable to prepare a syndet bar mass whose physical properties are virtually identical to soap enabling it to be processed into bars by exactly the same procedures normally used with soap to yield a syndet toilet bar whose appearance, texture, smooth feel and plasticity are virtually identical to and indistinguishable from soap bars. Such a bar should also have a wear rate similar to soap and dissolve in water to an extent similar to soap when left in a wet soap dish.

SUMMARY OF THE INVENTION

It is accordingly an object of the present invention to provide a novel and improved binder system for detergent bars as well as detergent bar compositions containing such binder systems.

Broadly speaking, the binder system of the invention comprises two ingredients, i.e. (a) fatty acid or alcohol component having an iodine number less than about 20 and a melting point of at least about 50° C. and being selected from the group consisting of fatty acids or alcohols having from 12 to 22 carbon atoms, mono-, di- or triglycerides of such fatty acids, fatty acid esters of such fatty alcohols and mixtures thereof and (b) alkyl amid represented by the formula:

$$R_1-\overset{\overset{\displaystyle O}{\|}}{C}-NHR_2$$

where $R_1$ represents a straight chain alkyl radical containing from 10 to 22 carbon atoms and $R_2$ represents hydrogen or an alkyl radical containing from 1 to 3 carbon atoms. The amide content of this binder system may be between 2 and about 30 wt% based on said ingredients (a) and (b).

The detergent bar composition of the invention comprises between about 20 and about 70 wt% of the binder of the invention and between about 30 and about 80 wt% anionic foaming and foam boosting detergents. Between about 3 and about 15 wt% water is also preferred.

DETAILED DESCRIPTION OF THE INVENTION

Fatty alcohol or acid components suitable for use in binders and detergent bars of the invention can be either natural or synthetic. Suitable materials for use in either the alcohol or acid form include for instance stearyl, lauryl, myristyl, cetyl, behenyl, $C_{20}$ synthetic alcohol or acid, etc. Mono-, di- or triglycerides of such fatty acids may be used as may fatty acid esters of such fatty alcohols. Preferred alcohol/acids include stearyl alcohol, stearic acid, cetyl alcohol, palmitic acid and commercial mixtures of cetyl stearyl alcohols and acids.

In addition to the required ingredients of the binder composition of the invention, other more conventional binder ingredients such as cornstarch, lanolin, paraffin, etc. may be included, provided excessive amounts are not used. Amounts up to about 20 wt% based on binder of such other ingredients are frequently acceptable. Hydrogenated triglycerides of animal or vegetable origin may also be included in amounts between about 5 and about 50 wt% based on binder.

The amide component of the binder need not be limited to compounds containing alkyl radicals of a single set carbon number but may include mixtures thereof, such as found in coconut amide. In addition, $R_1$ may represent a saturated or unsaturated alkyl radical. When substituted amides are utilized, they likewise need not be of the same type of substitution. For example, a mixture of 50 percent stearyl amide and 50% N-methylstearamide is within the scope of the present invention. Specific examples of amides suitable for use in the present invention, but by no means an exhaustive list include: dodecanamide, tridecanamide, tetradecanamide, hecdecanamide, octadeconamide, oleamide, linoleamide, N-methyltetradecanamide, N-methylhexadecanamid, N-methyloctadecanamide, etc. A particularly suitable commercial mixture of alkyl amides is avaitable under the trade name armid HT and has the following composition:

| Amide | Weight % |
|---|---|
| Tetradecanamide | 2.0 |
| Pentadecanamide | 0.5 |
| Hexadecanamide | 22 |
| Heptadecanamide | 1.5 |
| Octadecanamide | 71 |
| 9-Octadecanamide | 3 |

The detergent bar of the invention is formed in a conventional manner using conventional equipment and comprises from about 20 to about 70 wt% of binder composition of the invention and from about 30 to about 80 wt% anionic foaming and foam boosting detergents. Additional optional or prefered ingredients of the detergent bar composition include other more conventional binders, other types of detergent, other conventional additives such as fillers, builders, conditioners, opacifiers, pH modifiers, texture modifiers, perfumes, etc., and, if desired, small amounts, such as between about 0.5 and about 5 wt%, soap.

The ratio of the two required components of binder of the invention determines to a large extent the final texture and physical characteristics of the bar. If a harder bar is desired, the binder used should be relatively rich in the amide component, whereas if a relatively softer bar is desired, the amount of fatty alcohol or acid component to the amount of amide should be increased. Preferred compositions include weight ratios of amides to fatty alcohol component between about 4 to 1 and about 1 to 1. Preferred compositions include weight ratios of amide to fatty alcohol component, between about 4 to 1 and about 1 to 1. Preferred ratios of amide to fatty acid component are between about 1 to 9 and about 1 to 3.

The degree of hydrogenation of any triglycerides (fats) used in the invention is expressed by iodine number and titer. As expressed herein iodine number and titer are determined as set forth in Section D 460 of ASTM standards, 1973 edition. The iodine number is expressed as the percentage of iodine (grams per 100 grams) absorbed by the material and is a measure of residual unsaturation in the product. Hydrogenation reduces the unsaturation and lowers iodine number. Triglycerides suitable for use in the present invention should be hydrogenated to an extent such that the product has an iodine number less than about 20. The titer of a fat designates its melting point, or perhaps more appropriately, its setting point. Hydrogenation causes hardening of fats or oils and increases their titer. The titer of the product depends on the degree of hydrogenation and the titer of the starting fat is expressed in terms of °C. Animal or vegetable fats or oils are triglycerides, i.e. triesters of glycerin, and upon hydrolysis give fatty acids and glycerin. The titer of fat depends upon the length of the fatty acid and its structure. Both the size of the carbon chain and the structure, particularly the degree of unsaturation present in the fatty acids of any particular triglyceride, determines its titer. In general, higher chain length and lower unsaturation gives higher titer.

Foaming and foam boosting detergents suitable for use as the essential component of detergent bars of the invention are those generally known for use in synthetic detergent compositions and include for instance those made from long chain alkyl isethionates such as sodium coconut acid isethionate, sodium lauric isethionate, sodium myristic isethionate, N- long chain acyl N-alkyl taurates such as sodium coconut acyl methyl taurate, sodium palmitoyl methyl taurate, sodium myristoyl methyl taurate, and the corresponding acyl ethyl taurates, long chain olefin sulfonates such as sodium $C_{12-18}$ d-olefin sulfonates, long chain alkyl aryl sulfonates such as sodium octyl-, nonyldodecyl, decyl- and tetradecyl benzene sulfonate, long chain alkyl sulfates such as sodium or potassium coconut derived alkyl sulfate, sodium or potassium lauryl and stearyl sulfates, long chain alkyl oxyethylene sulfates such as sodium or potassium lauryl polyoxyethylene sulfate, sodium lauryl monoxyethylene sulfate, sodium octa-decyl polyoxyethylene sulfate, and sodium cetylpolyoxyethylene sulfate, long chain alkyl aryl oxyethylene sulfates such as ammonium, sodium, or potassium nonyl-, octyl-and tridecyl- phenol mono and polyoxyethylene sulfates, alkyl esters of aliphatic sulfocarboxylic acids such as sodium nonyl sulfosuccinate, sodium dioctyl sulfosuccinate, sodium diamyl sulfosuccinate, sodium triisobutyl sulfotricarballylate, sodium tri-n-butyl sulfotricarballylate, and the like. Mixtures of the above mentioned detergents may also be employed. These detergents or mixtures thereof are used from about 30 to 80% but preferably from 30 to 60% by weight of the bar. Particularly suitable synthetic detergents for the purpose of the current invention are the long chain alkyl isethionates and the N- long chain acyl N-alkyl taurates.

In addition to the foaming and foam boosting detergents mentioned above, certain nonionic surfactants such as long chain alcohol or fatty acid or alkyl phenol ethoxylates of waxy consistency may optionally be used in conjunction with the anionic surfactants described above to impart especially desirable lathering characteristics or for improving physical properties of the bar. Such nonionic surfactants, where used, may be used in amounts between about 1 and about 20% by weight of the total detergent bar composition. Examples of suitable surfactants of this type are e.g. the adduct of one mole dinonyl phenoyl and 100 moles of ethylene oxide, the adduct of one mole $C_8$–$C_{10}$ alcohol and 150 moles of ethylene oxide, etc.

Further descriptions of detergents and surfactants suitable for use in the invention are found for instance in the above identified U.S. Patents.

Where bars having especially creamy lather or improved hair conditioning properties are desired, it is frequently preferred to include in the bar between about 0.1 and about 1.5 wt% of a cationic nitrogen-containing polymer having a molecular weight between about 2,000 and about 3,000,000 and a cationic charge density greater than 0.001 in aqueous solution.

The term "cationic charge density" as used herein refers to the ratio of the number of positive charges on a repeating unit of the polymer to the molecular weight of the repeating unit. The cationic charge density multiplied by the polymer molecular weight determines the number of positively charged active sites on a given polymer chain.

Cationic polymers suitable for use in syndet bars of the invention include for instance polyethylenimines, alkoxylated polyethylenimines, polymers in which at least about 30 mol percent of the molecular structure is composed of monomeric units containing one or more quaternary ammonium groups with any balance comprising non-quaternized polymeric units derived from monoethylenically unsaturated monomeric groups, water soluble quaternary nitrogen substituted cellulose ether derivatives, water soluble linear polyamines, water soluble polymers of tetraethylene pentamine and epichlorohydrin, etc. Such cationic polymers are described in greater detail in U.S. Pat. No. 3,761,418. Expecially preferred cationic polymers for use in the invention are copolymers of vinyl pyrrolidone (VP) and N, N-dimethylamino-ethylmethacrylate (DMAEMA) having molecular weights between about 100,000 and about 2,000,000. Additional preferred polymers are water soluble quaternary nitrogen substituted cellulose ether derivatives.

Additional optional additives such as fillers, builders, conditioners, opacifiers, pH modifiers, texture modifiers, perfumes, water and the like may also be added to the detergent bar of the invention to provide properties regarded as desirable in any particular instance. Where used, such additives usually total less than about 20 wt% of the composition of the detergent bar, more usually between about 1 and about 10 wt%. Such additional additives may include for instance glycerine (frequently used in amounts between about 1 and about 8 wt%), propylene glycol, hexylene glycol, polyethylene glycol, starch (substituted, degraded or undegraded), lignin, alginates, copolymers of maleic anhydride with styrene or vinyl alkyl ethers, urea, lanolin, talc, salts such as borax, calcium chloride, ammonium chloride, sodium sulfate, sodium chloride, sodium tripolyphosphate, titanium dioxide etc., pigments, dyes, perfumes and the like. The use of these optional ingredients must, however, be very carefully regulated to prevent undesirable and disadvantageous properties from resulting. Thus, some inorganic salts are too soluble and are leached out of the bar, making it rough. Others are insoluble or only slightly soluble so that they are left as rough, gritty particles on the surface of the bar when the more soluble portions are dissolved out. Many crystallize out on the surface of the bar during storage. Some are too hydroscopic, causing excessive softening of the bar on storage in humid conditions. Varying amounts of inorganic salts such as sodium sulfate, sodium chloride, ammonium chloride and the like are present in certain of the surfactants employed in the bar as manufactured, but generally, and preferably, total no more than 10% by weight of the bar. Bars containing clay and bentonite usually having a gritty feel and insufficient slip. Starches, gums, etc. are unsatisfactory in very large amounts in that they tend to reduce slip of the bar. Those of low solubility are preferred since they reduce the rate of consumption of the bar.

Syndet bars of the invention may be made in any suitable manner but are preferably made by first forming syndet flakes and then making bars from the flakes. Syndet flakes may be prepared by melting binder system ingredients together in a suitable vessel equipped with an agitation device, such as a propellor, Crutcher mixer, etc. the melted mixture is maintained at 75° C. to 90° C. throughout the preparation procedure. The synthetic detergents are then mixed into the batch followed by the addition of water and other water soluble ingredients. The mixture is agitated sufficiently to yield homogenous, slightly viscous liquid free of lumps or discrete particles. The hot liquid is then cooled to form a solid and processed into a flake or coarse granular powder. Solidification of this hot melt is most conveniently done by employing cylindrical chill roll equipment which yields a uniform, flaked product. These syndet flakes may then be blended with desired additives such as, perfume oils, additional water, dyes, pigments, fillers, acid buffers for pH control, additional emollient ingredients, antibacterial agents, medicants, etc., thus permitting a variety of synthetic detergent bar products to be made from a single syndet flake formulation. Amalgamation of these ingredients is achieved by mixing in a ribbon blender, tumble mixer or other device suitable for mixing granular solids. The amalgamated mixture is then homogenized by passing the mixture through a roller mill or more economically by extruding the amalgamated mixture through a soap plodder equipped with refining plate and screen (about 40 mesh) yielding refined, homogenous pellets. Bar forming is then accomplished by extruding the refined mass from vaccum extruders into a strand with a cross-section approximating the customary commercial toilet soap bar. By cutting and stamping of these strands, products of the desired shape and size were obtained. The resulting bars freely release from the stamping molds. Stamping molds with curved or intricate shapes and lettering can be used to yield cleanly stamped, glossy bars which are smooth and free of grit. Use of similar syndet flakes not containing alkyl amides yield bars of gritty or sandy texture lacking in gloss, do not release well from stamping molds and do not yield clean lettering or accept curved shapes without cracking.

While the pH of detergent bars of the invention may vary widely, most suitable compositions have a pH within the range of between about 3.5 and about 7.5 and it is one of the advantages of the invention that the use of the binder system of the invention permits the preparation of syndet bars within the so callred "acid mantle" pH range of 5.0–6.0 while maintaining the elegant, smooth texture and physical properties of a hard milled soap. Accordingly, preferred detergent bars of the invention have a pH between about 5.0 and about 6.0. (For purposes of this disclosure, pH of the detergent bars of the invention is to be determined by measuring the pH of a 1.0 wt% aqueous solution of such bars.) Currently available syndet bars which utilize soap as a binder cannot be prepared at this pH as the soap decomposes to salt and fatty acid at an acidic pH. Other syndet bars currently available which, while slightly acidic, lack the elegant soap-like texture obtained with the binder system described herein, are hard and brittle, do not possess the smoothness and slip of soap, often lack good lathering qualities and are difficult to process in conventional soap making machinery because they are less plastic than soap. These problems are largely eliminated by the use of the binder system described herein.

The concept of "acid-mantle" is based on the fact that, on the average, normal skin has a pH of approximately 5.5 and that products applied to the skin, such as cleansing products, creams, lotions, etc. should have a similar pH to avoid upsetting the natural chemical mechanisms which maintain the skin at pH 5.5. It is known that the use of alkaline soap will upset this natural pH balance and increase the pH of skin. This results in increased lipid removal, increased growth of microorganisms on the skin, and softening of the proten tissues of the skin. These changes are not desirable as they are not representative of healthy skin. Syndet bars can be made according to the current invention which are isotonic with skin pH and yet they effectively cleanse the skin of soil and excess oils without defatting the skin, have excellent lathering qualities, do not soften or degrade protein cells of the skin and maintain the "acid mantle" which is thought to be a defense mechanism to prevent overgrowth of infectious microorganisms.

Detergent bars made with the combination binders of the current invention have excellent physical properties and superior performance characteristics. These superior characteristics are achieved in bars of the current invention without recourse to the use of soaps as an essential ingredient of the bars. The bars of the current invention are thus free from the drawbacks associated with soaps. Leading commercial detergent bars generally contain soap (usually in the form of alkaline metal or alkaline earth metal soaps) as binder for the synthetic detergents and are thus actually synthetic detergent-soap combination bars rather than true syndet bars. It must be pointed out, however, that although soap is not an essential ingredient of the bars of the current invention, small amounts of conventional soaps, such as between about 0.5 and about 5.0% by weight of the bar, can frequently be used as an optional ingredient without substantial detriment.

EXAMPLES

The following examples are intended to illustrate various embodiments of the invention without limiting the scope thereof.

EXAMPLE 1

A syndet toilet bar of the invention was made using the following ingredients:

| Ingredients | Parts by Weight |
|---|---|
| 1. Stearic acid, triple pleased | 37.5 |
| 2. Alkyl amide (Armid HT) | 5.0 |
| 3. Hydrogenated Tallow glycerides | 5.0 |
| 4. Sodium cocoyl isethionate | 45.0 |
| 5. Water | 7.5 |
| Syndet Flakes | 100.0 |
| 6. Perfume | 1.0 |
| 7. Citric acid | 0.6 |
| 8. Water dye solution | 2.5 |
| 9. Titanium dioxide | 0.4 |
| | 104.5 |

Components 1,2 and 3 which constitute the binder system were mixed and heated to a melt at 70° C. Components 4 and 5 were then added with additional mixing with the temperature of the mix being maintained at 70°-80° C. After 15 minutes the resulting smooth paste was cooled to 50° C. and passed through a water cooled, three roll mill to produce solid flakes. The solid flakes so formed were mixed in a ribbon blender with components 6-10 for 10 to 15 minutes and then again passed twice through the three roll mill. The flakes were then processed twice through a soap plodder to give a long extruded bar which was cut into toilet sized bars and stamped into shape. These bars had a pH of 5.5 as a 1% water solution. No difficulties were encounted in processing these bars, and the bars were considered of good quality for use as toilet bars.

EXAMPLE 2

Another suitable toilet bar of the invention may be made using the following ingredients:

EXAMPLE 2

| Ingredients | Parts by Weight |
|---|---|
| 1. Stearyl alcohol | 20.0 |
| 2. Stearin | 15.0 |
| 3. Myristamide | 7.0 |
| 4. Sodium cocoyl isethionate | 25.0 |
| 5. Sodium myristyl isethionate | 20.0 |
| 6. 24% active sodium-N-coco-N-methyl taurate | 7.5 |
| 7. Water | 5.5 |
| Syndet flakes | 100.0 |
| 8. Citric acid | 0.3 |
| 9. Perfume | 1.0 |
| 10. Water | 3.0 |
| | 104.3 |

The pH of this bar will be about 7.0 as a 1% water solution.

Another suitable toilet bar of the invention may be made using the following ingredients:

EXAMPLE 3

| Ingredients | Parts by Weight |
|---|---|
| 1. Cetyl-stearyl alcohol | 10.0 |
| 2. Hydrogenate tallow glycerides | 20.0 |
| 3. Oleamide | 2.0 |
| 4. Coconut amide | 5.0 |
| 5. Sodium cocoyl isethionate | 45.0 |
| 6. 24% active sodium-N-coco-N-methyl taurate | 8.0 |
| 7. Glycerine | 4.0 |
| 8. Water | 6.0 |
| Syndet flakes | 100.0 |
| 9. Perfume | 1.0 |
| 10. Citric acid | 0.5 |
| 11. Water | 2.0 |

The pH of this bar will be about 5.5 as a 1% water solution.

EXAMPLE 4

A syndet bar according to the invention was produced by adding 10 parts sodium cocoyl isethionate to 100 parts of syndet flakes produced according to Example 1. This yielded a very high foaming bar particularly well suited for use as a shampoo product.

EXAMPLE 5

A syndet bar was made in accordance with the invention by the process of Example 1, except that in addition to the ingredients listed in Example 1, 2% of a cationic resin of average molecular weight above 1 million (Gafquat 755N) produced by GAF Corporation in the form of a 20% resin content solution was added to the ingredients from which the bar with creamier, more luxurious lather and increased emollient effect.

EXAMPLE 6

A syndet bar according to the invention was made according to the process of Example 1, except that in addition to the ingredients shown in Example 1, 1% of a cationic resin produced by Union Carbide Corp. (polymer JR) was added. The resulting bar had properties very similar to the bar produced in Example 5.

While the invention has been described above with respect to preferred embodiment thereof, it will be understood by those skilled in the art that various changes and modifications may be made without departing from the spirit or scope of the invention.

What is claimed is:

1. A detergent bar binder composition comprising the following combination of ingredients:

(a) fatty acid or alcohol component having an iodine number less than about 20 and a melting point of at least about 50° C. and being selected from the group consisting of fatty acids or alcohols having from 12 to 22 carbon atoms, mono-, di- or tri-glycerides of such fatty acids, fatty acid esters of such fatty alcohols and mixtures thereof and;

(b) alkyl amide represented by the formula:

$$R_1-\overset{\overset{\displaystyle O}{\|}}{C}-NHR_2$$

where $R_1$ represents a straight chain alkyl radial containing from 10 to 22 carbon atoms and $R_2$ represents hydrogen or an alkyl radical containing from 1 to 3 carbon atoms, said alkyl amide being present in an amount between about 2 and about 30 wt% of said binder composition and said fatty acid or alcohol component being present in an amount between about 70 and about 90 wt% of said binder composition.

2. Binder composition according to claim 1 which also includes between about 5 and about 50 wt% triglyceride of animal or vegetable origin having a titer above about 50 and an iodine number less than about 20.

3. A detergent bar comprising the following combination of ingredients:

(a) between about 20 and about 70 wt% of the binder composition of claim 1; and (b) between about 30 and about 80 wt% anionic foaming and foam boosting detergent.

4. A detergent bar according to claim 3 wherein the pH of the bar is between about 3.5 and about 7.5.

5. A detergent bar according to claim 3 wherein the bar comprises between about 30 and about 60 wt% detergent.

6. A detergent bar according to claim 3 which also comprises between about 1 and about 20 wt% nonionic detergent.

7. A detergent bar according to claim 3 wherein the binder includes stearic acid, the bar also includes between about 1 and about 20 wt% nonionic surfactant and between about 1 and about 8 wt% glycerin and in which the pH of the bar is between about 5.0 and about 6.0.

8. A detergent bar according to claim 5 which also comprises between about 0.1 and about 1.5 wt% of a cationic nitrogen-containing polymer having a molecular weight between about 2,000 and about 3,000,000 and a cationic charge density greater than 0.001 in aqueous solution, said polymer being a nitrogen substituted cellulose ether derivative formed by reacting hydroxyethylcellulose with the reaction product of epichlorohydrin and trimethylamine.

* * * * *